US005109978A

United States Patent [19]

Cawley

[11] Patent Number: 5,109,978

[45] Date of Patent: May 5, 1992

[54] DISPENSER FOR PLASTIC BAGS

[76] Inventor: Darrell R. Cawley, 16840 11 Mile, Apt. 109, Roseville, Mich. 48066

[21] Appl. No.: 732,394

[22] Filed: Jul. 18, 1991

[51] Int. Cl.[5] ..... B65D 85/671

[52] U.S. Cl. ..... 206/225; 206/390; 221/45; 242/55.53

[58] Field of Search ..... 206/225, 390, 409, 554, 206/576; 221/45, 46, 63; 225/41, 54; 242/55.53; 312/37

[56] References Cited

U.S. PATENT DOCUMENTS

| | | | |
|---|---|---|---|
| 690,165 | 12/1901 | Leonard | 225/46 |
| 1,713,857 | 5/1929 | Rapp | 225/46 |
| 1,967,119 | 7/1934 | Gluck | 225/46 |
| 2,115,867 | 5/1938 | McConnell | 225/46 |
| 4,191,307 | 3/1980 | Lecaire, Jr. et al. | 221/45 |
| 4,349,123 | 9/1982 | Yang . | |
| 4,364,490 | 12/1982 | Lang et al. . | |
| 4,424,926 | 1/1984 | Gatward | 225/46 |
| 4,579,267 | 4/1986 | Planke | 225/54 |
| 4,714,191 | 12/1987 | Richardson . | |
| 4,844,310 | 7/1989 | Geleziunas | 225/54 |
| 4,850,486 | 7/1989 | Neibaur . | |
| 4,894,090 | 7/1989 | Case et al. . | |
| 4,904,092 | 2/1990 | Campbell et al. . | |
| 4,955,505 | 9/1990 | Battaglia . | |

FOREIGN PATENT DOCUMENTS

| | | | |
|---|---|---|---|
| 0144493 | 3/1954 | Sweden | 221/46 |
| 0477063 | 12/1937 | United Kingdom | 225/46 |

*Primary Examiner*—Jimmy G. Foster
*Attorney, Agent, or Firm*—Peter D. Keefe

[57] ABSTRACT

A dispensing receptacle for separable bags of a plastic bag roll, having four walls, a bottom connecting with the four walls, and an open top. One of the four walls is a front wall which is oriented at an angle away from an oppositely situate back wall. A small separation between the upper edge of the front wall and the top forms a slit through which plastic bags are dispensed. An opening in the top is dimensioned to permit a roll of plastic bags to be dropped into the interior of the dispenser, and thereupon rest upon skids located on the bottom. A holder for plastic bags ties is provided on one of the walls.

18 Claims, 2 Drawing Sheets

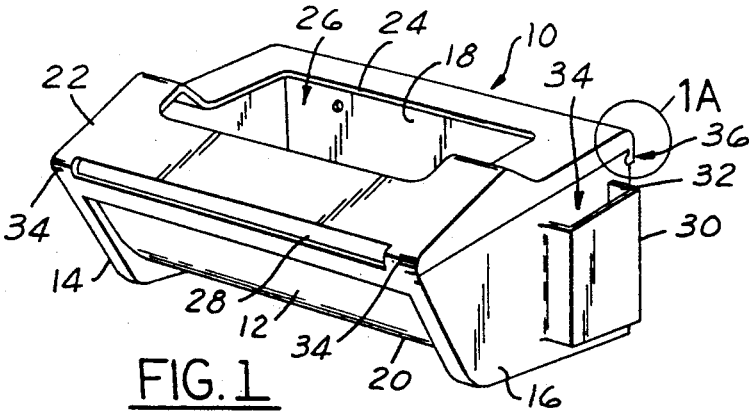
FIG. 1
FIG. 1A
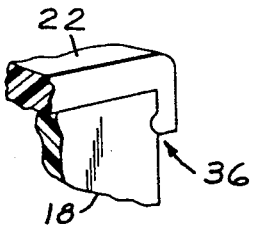
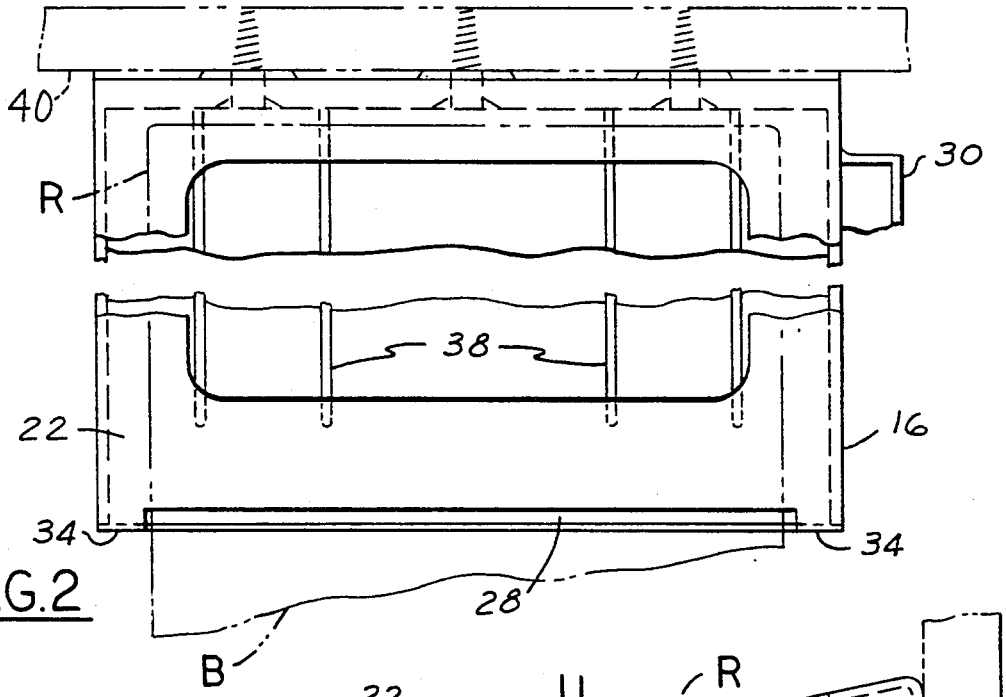
FIG. 2
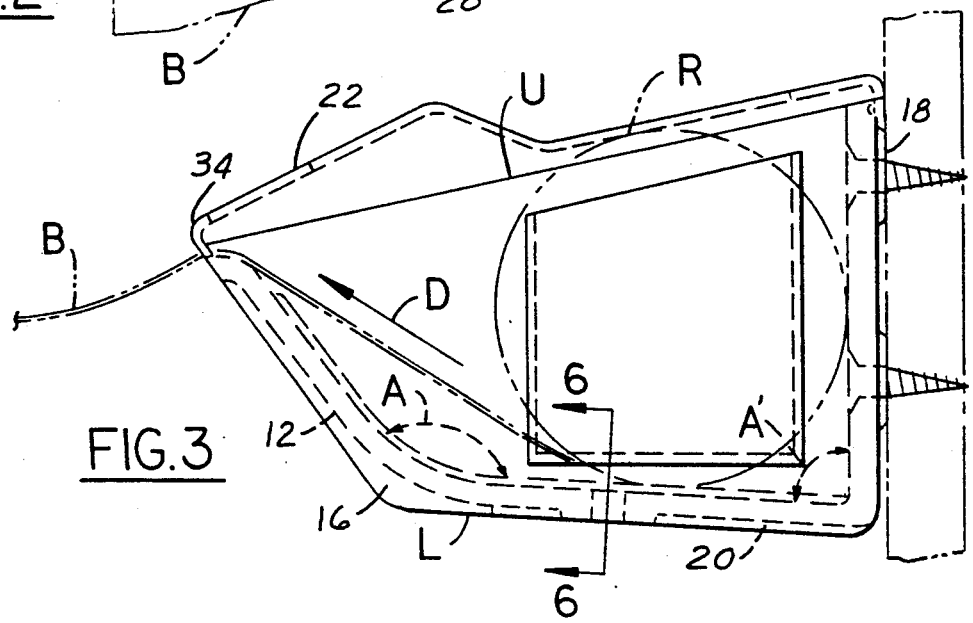
FIG. 3

DISPENSER FOR PLASTIC BAGS

BACKGROUND OF THE INVENTION

1. Field of the Invention

The present invention relates to dispensers for plastic bags, and in particular to a dispenser structured specifically to enable efficient dispensing of a roll of plastic bags, where the plastic bags are serially separably connected together.

2. Description of the Prior Art

Today, plastic bags have become extremely common for a variety of uses, such as for example trash collection, food stuff storage and medical purposes. Most conveniently, these bags are serially connected together in the form of a roll, each bag being separable from the next via a perforated connection therebetween. These rolls have the advantage of providing a very compact volume for the storage of the plastic bags. However, at times the roll can be difficult to handle, and should the roll ever happen to fall on the floor, it can unroll itself in a rather unpleasant manner. Accordingly, what is needed is some sort of dispenser structure for holding the plastic bag roll.

The prior art of plastic bag dispensers is exemplified by the following U.S. patents. U.S. Pat. No. 4,349,123 to Yang, dated Sept. 14, 1982, discloses a garbage can having at its bottom a box shaped dispenser for folded trash bags, the bags dispensing out a top mounted slot. U.S. Pat. No. 4,364,490 to Lang et al, dated Dec. 21, 1982, discloses a refuse receptacle having at its bottom a box shaped dispenser for rolled trash bags which are rather complexly loaded into the dispenser, the bags dispensing out of a top mounted slot. U.S. Pat. No. 4,714,191 to Richardson, dated Dec. 22, 1987, discloses a flat cardboard that folds into a dispenser for plastic bags through a top located opening, the preferred bags have tabs which interact with a tab on the dispenser to aid separation of the bags at the time of dispensing. U.S. Pat. No. 4,850,486 to Neibaur, dated July 25, 1989, discloses a plastic bag dispenser shaped similar to a facial tissue box, the dispenser having a trash bag tie holder incorporated into it. Finally, U.S. Pat. No. 4,955,505 to Battaglia, dated Sept. 11, 1990, discloses a refuse receptacle having at its bottom a box shaped dispenser for a spindled roll of trash bags, the bags dispensing out of a top mounted slot.

Prior art plastic bag rolls are well known, and some variations have been developed, exemplified by the following U.S. patents. U.S. Pat. No. 4,894,090 to Case et al, dated July 18, 1989, discloses a plastic bag roll employing a releasable adhesive selectively located on the plastic bags so that as the lead bag is pulled, the adhesive facilitates separation of the bag along its severance line. U.S. Pat. No. 4,904,092 to Campbell et al disclose plastic bag rolls employing a releasable adhesive selectively located on the plastic bags so that as the lead bag is pulled, it is caused to be opened.

While the prior art offers a variety of structures relating to plastic bags and their dispensement, they are operationally cumbersome with respect to the combination of placing the plastic bag roll into the dispenser, providing for rotation of the roll within the dispenser and accommodating the problem that when the roll is near its end, the much smaller diameter and lesser weight thereof, results in the whole roll exiting the dispenser instead of just the lead bag. Accordingly, what remains needed in the prior art is a dispenser for a plastic bag roll which provides for easy placement of the roll into the dispenser and efficient dispensing of bags from the roll, especially when only a few plastic bags yet remain on the roll, without need of a spindle.

SUMMARY OF THE INVENTION

The present invention is a dispenser for a plastic bag roll which provides for easy placement of the roll into the dispenser and efficient dispensing of bags from the roll, especially when only a few plastic bags yet remain on the roll, without need of a spindle.

The dispenser according to the present invention is structured to serve as a dispensing receptacle for separable bags of a plastic bag roll, having four walls, a bottom connecting with the four walls, and an open top. One of the four walls is a front wall which is oriented at an angle away from an oppositely situate back wall. A small separation between the upper edge of the front wall and the top forms a slot through which plastic bags are dispensed. An opening in the top is dimensioned to permit a roll of plastic bags to be dropped into the interior of the dispenser. The roll rests in a rotatably free manner, without a spindle connection with the dispenser, upon skids located on the bottom.

A holder for plastic bag ties is provided on one, or both, of the side walls. The dispenser may be mounted to a vertical surface utilizing common fasteners with respect to the back wall, or mounted to a horizontal surface utilizing common fasteners with respect to the bottom.

It is preferred for the dispenser to be formed of plastic via a single injection molding process operation. In this regard, it is further preferred for the top to be connected with the front wall by a living hinge at either side of the dispensing slot, and for the top to be locked with respect to the four walls by a latch interconnection between the top and the back wall.

In operation, a user drops a roll of plastic bags into the opening in the top so that the roll rests on the skids. The roll is then manipulated to that the lead bag is threaded partly out through the dispensing slot. As bags are dispensed, the diameter of the roll will decrease, but because of the narrowness of the dispensing slot, which is preferably smaller than the diameter of a roll having only the last remaining bag, and, further, the angling of the front wall toward the dispensing slot, every bag will dispense efficiently in an unrolled manner until the last bag of the roll is dispensed.

Accordingly, it is an object of the present invention to provide a plastic bad dispenser which is structured to efficiently dispense every bag of the roll in a serial manner.

It is a further object of the present invention to provide a plastic bag dispenser which is easy to use, inexpensive and cooperates with the roll in a manner that ensures that only unrolled bags exit the dispenser as the lead bag is pulled.

These, and additional objects, advantages, features and benefits of the present invention will become apparent from the following specification.

BRIEF DESCRIPTION OF THE DRAWINGS

FIG. 1 is a perspective view of the dispenser for plastic bag rolls according to the present invention.

FIG. 1A is a fragmentary, perspective detail view of the latching mechanism for the top according to the present invention, as seen in circle 1A of FIG. 1.

FIG. 2 is a top plan view of the dispenser according to the present invention, shown in operation with a roll of plastic bags.

FIG. 3 is a side view of the dispenser according to the present invention, shown in operation with a roll of plastic bags.

DETAILED DESCRIPTION OF THE PREFERRED EMBODIMENT

Figure 4:
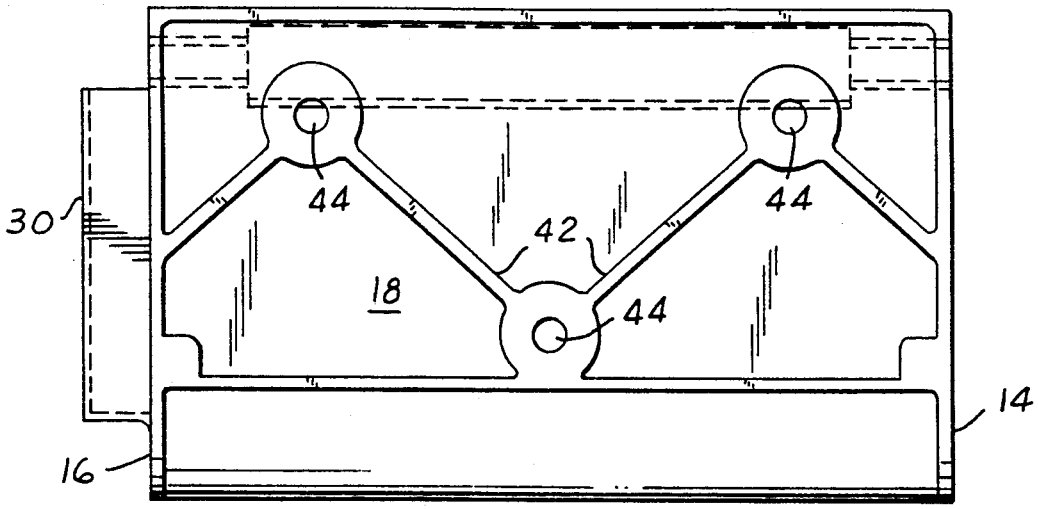
FIG. 4 is a rear view of the dispenser according to the present invention.
Figure 5:
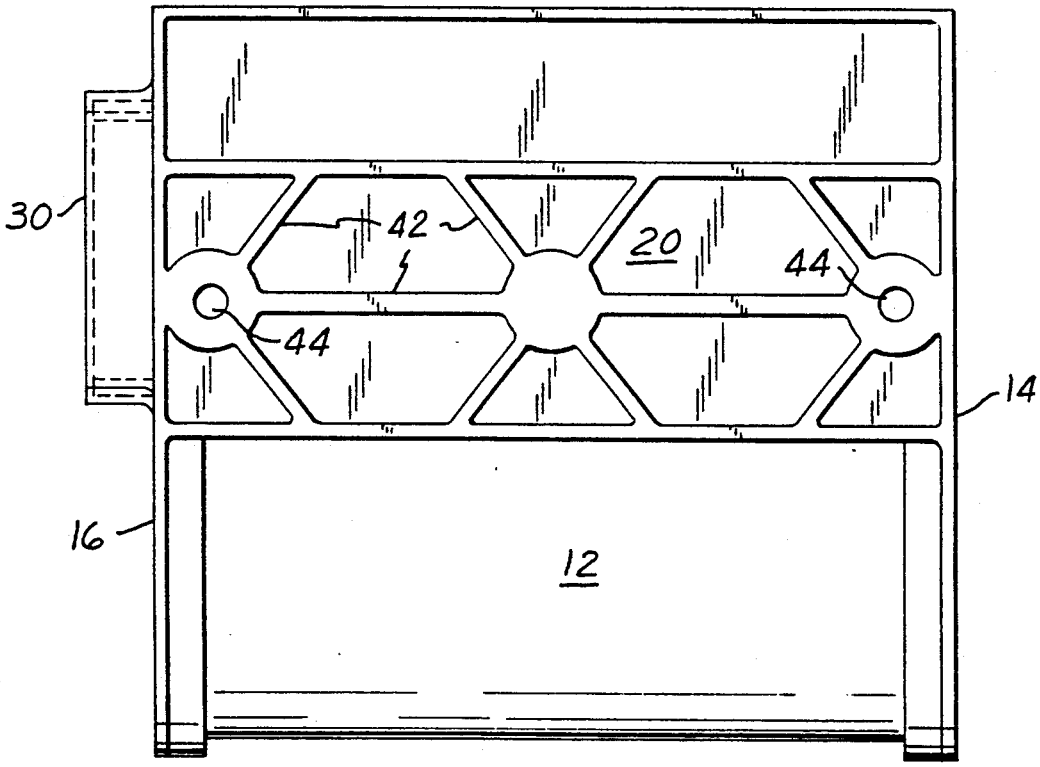
FIG. 5 is a bottom view of the dispenser according to the present invention.
Figure 6:
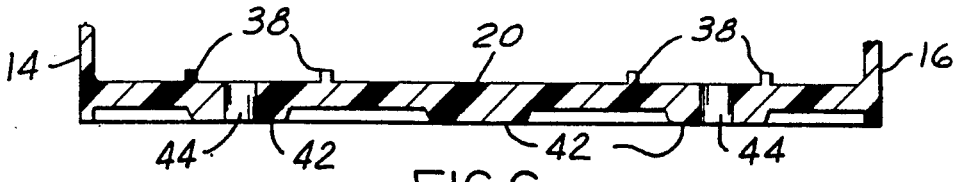
FIG. 6 is a sectional view of the bottom of the dispenser according to the present invention, seen along lines 6—6 in FIG. 3.

Referring now to the Drawing, FIG. 1 generally shows the dispenser 10. As can be discerned, the dispenser 10 is composed of a front wall 12, left and right side walls 14, 16 each connected with the front wall, a rear wall 18 connected with the left and right side walls, a bottom 20 connected with the lower end L of the walls and a top 22 connected with the upper end U of the walls. The top 22 is provided with an opening 24 dimensioned so as to permit a roll of plastic bags to be dropped into the interior 26 of the dispenser 10. Located between the top 22 and the upper end of the front wall 12 is a dispensing slot 28 dimensioned so as to allow to pass therethrough bags of the roll in a serial manner as the lead bag of the roll is pulled by a user. In this regard, preferably the dispensing slot has a width dimension a little larger than the width of a bag flatly coming off the roll, and further has a height dimension such that only flat, unrolled bags may pass therethrough. A bag tie receptacle 30 is located on one side wall of the dispenser 10, here shown at the right side 16, an open end 32 thereof providing storage access for bag ties within the interior space 34 thereof. It is preferred for the bag tie receptacle 30 to be integral with the side wall.

It is preferred for the dispenser to be constructed of a plastic material and be formed by a single injection molding process. In this regard, the product of the injection molding process preferably involves two components: a main body component composed of the walls with connected bottom and a top component composed of the top; the two components are connected together at living hinges 34 located on either side of the dispensing slot 28. After injection molding, the top is pivoted on the living hinges relative to the upper end of the walls, and is thereupon secured to the back wall 18 via a snapping engagement therewith by a latch mechanism 36.

In order that the roll R unroll in an efficient manner without need of a spindle, it is preferred for the front wall 12 to be angled away from the rear wall 18 characterized by an interior angle A relative to the bottom 20 of substantially more than 90 degrees, preferably on the order of about 110 to 135 degrees. Thusly, when a leading bag B is pulled, the roll can easily rotate dispensably relative to the dispensing slot 28. This is especially the case when the roll is near to being exhausted, as the roll can then migrate up the front wall toward the dispensing slot. It is further preferred for the roll to rest upon skids 40 located on the bottom 20. The skids permit easier rotation of the roll as bags are dispensed, since friction between the roll R and the bottom is minimized, especially when the roll is new and relatively heavy.

It is further preferred for the portion of the top 22 adjacent the dispensing slot 28 to form an acute angle with a plane parallel with the bottom, as measured at the interior 26 of the dispenser 10. This acute angle relationship facilitates unrolling of a roll when near exhaustion, when the roll tends to be substantially located adjacent the dispensing slot as the leading bag is pulled.

It is preferred for the roll R to rest on the skids 38 so that bags unroll in the direction indicated by arrow D in FIG. 3, wherein the bags unroll from underneath the roll. This manner of operation ensures the most efficient unrolling of the roll during bag dispensement, as rotation of the roll tends to make it roll toward the back wall 18, away from the dispensing slot 28. To further facilitate the desired tendency for the roll R to be located adjacent the rear wall 18 while bag dispensing is occurring, it is preferred for the bottom 20 to be angled relative to the back wall at an angle A' of less than 90 degrees, preferably on the order of about 75 to 85 degrees.

It is preferred for the dispenser 10 to be mounted to an immovable surface, such as a vertical room wall surface 40, as shown in FIGS. 2 and 3, or a horizontal table top surface. In order to provide a maximum of structural strength, and yet provide low cost and low weight, structural ribs 42 are provided on the back wall 18 and the bottom 20. The structural ribs further surround holes 44 for common fasteners, such as screws or bolts by which the dispenser 10 can be secured to the immovable surface.

In operation, a user drops a roll of plastic bags R into the opening 24 in the top 22 so that the roll rests on the skids 38. The roll is then manipulated so that a portion of the lead bag B is threaded flatly out through the dispensing slot 28. As bags are dispensed, the diameter of the roll will decrease, but because of the narrowness of the dispensing slot, which is preferably smaller than the diameter of a roll having only the last remaining bag, and, further, the angling of the front wall toward the dispensing slot, every bag will dispense efficiently in an unrolled manner until the last bag of the roll is dispensed.

To those skilled in the art to which this invention appertains, the above described preferred embodiment may be subject to change or modification. For instance, while it is preferred for the top to be structured as depicted in the Drawing, alternatively the top may simply be limited to only that portion shown in the Drawing adjacent the front wall, with which, in combination, the dispensing slot is defined. Such change or modification can be carried out without departing from the scope of the invention, which is intended to be limited only by the scope of the appended claims.

What is claimed is:

1. A dispenser for plastic bags, the plastic bags being mutually serially joined in a severable manner and rolled into a roll, said dispenser comprising:

a front wall having an upper end, a lower end, a right side and a left side;

a rear wall having an upper end, a lower end, a right side and a left side;

a right side wall generally connected with said right side of said front and rear walls, said right side wall having an upper end and a lower end;

a left side wall generally connected with said left side of said front and rear walls, said left side wall having an upper end and a lower end;

a bottom generally connected with said lower end of each of said front, rear, right side and left side walls, said front wall being angled relative to said bottom at an interior angle therebetween of substantially larger than 90 degrees; and a top generally connected with said upper end of at least one of said front wall, said right side wall and said left side wall, said top and said front wall in combination forming a dispensing slot through which the plastic bags are passable, said top having an opening dimensioned so that the roll is passable therethrough.

2. The dispenser of claim 1, wherein said interior angle between said front wall and said bottom is substantially between 110 and 135 degrees.

3. The dispenser of claim 2, wherein said dispensing slot has a height dimension, wherein further the roll has a diameter; said height dimension of said dispensing slot being less than the diameter of the roll when the roll is composed of only a single plastic bag.

4. The dispenser of claim 3, further comprising a plurality of skids located on said bottom for rotatably supporting the roll.

5. The dispenser of claim 4, wherein said bottom is oriented relative to said rear wall at an interior angle therebetween of less than 90 degrees.

6. The dispenser of claim 5, wherein said interior angle between said rear wall and said bottom is substantially between 75 and 85 degrees.

7. The dispenser of claim 6, wherein that portion of said top adjacent said dispensing slot is oriented at an acute interior angle relative to a plane parallel with said bottom.

8. The dispenser of claim 7, further comprising a receptacle for holding plastic bag ties, said receptacle being connected with at least one of said right and left sidewalls.

9. The dispenser of claim 1, wherein said dispensing slot has a height dimension, wherein further the roll has a diameter; said height dimension of said dispensing slot being less than the diameter of the roll when the roll is composed of only a single plastic bag.

10. The dispenser of claim 9, further comprising a plurality of skids located on said bottom for rotatably supporting the roll.

11. The dispenser of claim 10, wherein said bottom is oriented relative to said rear wall at an interior angle therebetween of less than 90 degrees.

12. The dispenser of claim 11, wherein that portion of said top adjacent said dispensing slot is oriented at an acute interior angle relative to a plane parallel with said bottom.

13. The dispenser of claim 12, further comprising a receptacle for holding plastic bag ties, said receptacle being connected with at least one of said right and left sidewalls.

14. The dispenser of claim 1, further comprising a plurality of skids located on said bottom for rotatably supporting the roll.

15. The dispenser of claim 1, wherein said bottom is oriented relative to said rear wall at an interior angle therebetween of less than 90 degrees.

16. The dispenser of claim 15, wherein said interior angle between said rear wall and said bottom is substantially between 75 and 85 degrees.

17. The dispenser of claim 1, wherein that portion of said top adjacent said dispensing slot is oriented at an acute interior angle relative to a plane parallel with said bottom.

18. The dispenser of claim 1, further comprising a receptacle for holding plastic bag ties, said receptacle being connected with at least one of said right and left sidewalls.

* * * * *